US007085521B2

(12) United States Patent
Park

(10) Patent No.: US 7,085,521 B2
(45) Date of Patent: Aug. 1, 2006

(54) DEVELOPING DEVICE FOR WET ELECTROPHOTOGRAPHIC PRINTER

(75) Inventor: Eun-Sang Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 181 days.

(21) Appl. No.: 10/780,559

(22) Filed: Feb. 19, 2004

(65) Prior Publication Data

US 2004/0253021 A1 Dec. 16, 2004

(30) Foreign Application Priority Data

Jun. 10, 2003 (KR) ..... 10-2003-0037284

(51) Int. Cl.
*G03G 15/10* (2006.01)

(52) U.S. Cl. ..... 399/237; 399/239
(58) Field of Classification Search ..... 399/237–251
See application file for complete search history.

(56) References Cited

U.S. PATENT DOCUMENTS

| | | | | |
|---|---|---|---|---|
| 4,733,273 | A * | 3/1988 | Lloyd | 399/239 |
| 5,153,659 | A * | 10/1992 | Maiefski et al. | 399/227 |
| 6,317,578 | B1 * | 11/2001 | Kusayanagi | 399/249 |
| 2004/0146317 | A1 * | 7/2004 | Park | 399/237 |
| 2004/0175206 | A1 * | 9/2004 | Landa et al. | 399/237 |

FOREIGN PATENT DOCUMENTS

| | | | |
|---|---|---|---|
| JP | 08-194382 | | 7/1996 |
| JP | 2001005297 | A * | 1/2001 |

* cited by examiner

*Primary Examiner*—Arthur T. Grimley
*Assistant Examiner*—Ryan Gleitz
(74) *Attorney, Agent, or Firm*—Roylance, Abrams, Berdo & Goodman LLP

(57) ABSTRACT

Disclosed is a developing unit of a wet electrophotographic printer, which has a photoconductive drum, a developing roller for transferring a developer onto the photoconductive drum, a cartridge for storing a developer therein, a developer guide disposed at a predetermined distance away from an inner wall of the cartridge, and having a developer supplying path defined therein to guide the developer in the cartridge to the developing roller, and a developer pumping means disposed in the cartridge to pump up the developer in the cartridge toward the developing roller.

18 Claims, 4 Drawing Sheets

DEVELOPING DEVICE FOR WET ELECTROPHOTOGRAPHIC PRINTER

BACKGROUND OF THE INVENTION

1. Field of the Invention

The present invention relates to a wet electrophotographic printer, and more particularly, to a developing unit of a wet electrophotographic printer having an improved developer supplying structure.

2. Description of the Related Art

Generally, a wet electrophotographic printer develops an image into a visible image by attaching a liquid developer on an electrostatic latent image which is formed on a photoconductive medium by a laser, and transfers the developed visible image to a printing paper to print. A developer for the wet electrophotographic printer consists of toner particles mixed with a volatile liquid carrier in a predetermined concentration, usually providing a better quality printing than a dry electrophotographic printer using a powder toner. It is also typically easier to print color images with the wet electrophotographic printer than with the dry type.

FIG. 1 schematically shows the structure of a conventional wet electrophotographic printer. As shown in FIG. 1, when a laser generated in an exposure device 10 is projected on a photoconductive drum 20, an electrostatic latent image is formed on the photoconductive drum 20. Then, a developing unit 30 develops the electrostatic latent image into a visible image by transferring the developer onto the electrostatic latent image. The developed visible image is then transferred to a transfer belt 40 and then to the printing paper P. The visible image, which is transferred onto the printing paper P, is fused onto the printing paper P while passing through a fusing unit 50.

FIG. 2 shows a conventional developing unit 30 for developing the electrostatic latent image, which is formed on the photoconductive drum 20. Referring to FIG. 2, in a cartridge 31 for storing the developer T, there is formed a partition 33 forming a developer supplying path 32 in cooperation with an inner wall 31*a* of the cartridge 31. At a lower part of the developer supplying path 32, a pumping roller 34 made of a sponge material is formed to contact with a lower part of the partition 33 under a predetermined pressure. As the pumping roller 34 rotates, the developer T held in the pumping roller 34 comes out from the pumping roller 34, moves up along the developer supplying path 32 and then to a deposit roller 36. The deposit roller 36 attaches the developer T onto the developing roller 37, and the developing roller 37 attaches the developer T onto the photoconductive drum 20. The developer T remaining on the developing roller 37 is removed by a cleaning roller 38.

However, in the conventional developing unit 30, the flow rate of the developer T which flows upward to the deposit roller 36 through the developer supplying path 32 varies according to various factors such as the level of the developer T of the cartridge 31, the viscosity of the developer, a pressure at which the pumping roller 34 contacts the lower part of the partition 33, and the amount of a developer sludge being wiped down by the cleaning roller 38. An irregular amount of developer T supplied into a deposit nip N between the developing roller 37 and the deposit roller 36 causes a deteriorated printing quality.

Further, in the conventional developing unit 30, the developer T from the cleaning roller 38 or the developing roller 37 is flowed into the developer supplying path 32 along the partition 33. Such developer T in a sludge form is directly supplied to the developing roller 37 with the developer T which is raised by the pumping roller 34, further deteriorating the printing quality.

SUMMARY OF THE INVENTION

It is an object of the present invention to provide a developing unit for supplying a developer to a developing roller in a constant flow rate, regardless of a level or a viscosity of the developer.

In order to achieve the above-described objects of the present invention, there is provided a developing unit of a wet electrophotographic printer according to an embodiment of the present invention that comprises a photoconductive drum, a developing roller for transferring developer onto the photoconductive drum, a developer guide being disposed at a predetermined distance from an inner wall of the cartridge, having a developer supplying path for guiding the developer in the cartridge to the developing roller, and a developer pumping means being disposed in the cartridge to pump the developer in the cartridge up to the developing roller.

The developing unit preferably comprises a deposit roller for transferring developer onto the developing roller, wherein a deposit nip is defined between the developing roller and the deposit roller.

In the developing unit according to an embodiment of the present invention, it is preferable that the developer guide comprises a first partition of which an upper part contacts with the deposit roller and a second partition disposed on a sidewall of the cartridge to form a developer supplying path between the first partition and the second partition, the upper part of the first partition is disposed lower than the deposit nip. The upper part of the second partition is disposed higher than the deposit nip, and the developer which flows along the developer supplying path is moved to a developer collecting path between the second partition and the inner wall of the cartridge, of which a part is moved to the deposit nip, and the remainder is overflowed to the upper part of the second partition.

In addition, the first partition and the second partition can be integrally mounted in the cartridge, connected by a connecting means, or separately mounted in the cartridge.

Further, the developer pumping means is a pumping roller which is made by a sponge material, being mounted to contact with the lower part of the developer guide.

Also, the developer pumping means is a pumping roller which is made by a sponge material, being mounted to contact with respective lower parts of the first partition and the second partition.

In addition, the pumping roller contacts with a higher pressure on the lower part of the second partition than on the lower part of the first partition, and rotates in a direction from the first partition to the second partition.

Furthermore, the lower part of the first partition is disposed higher than the lower part of the second partition.

A developing unit of a wet electrophotographic printer according to an embodiment of the present invention also comprises a cleaning roller for removing the developer remaining on the developing roller in contact with the developing roller, wherein the developer which is removed from the developing roller by the cleaning roller is moved into between the inner wall of the cartridge and the developer guide.

BRIEF DESCRIPTION OF THE DRAWING FIGURES

These and other features, aspects, and advantages of the present invention will become better understood with regard to the following description, appended claims, and accompanying drawing figures, in which:

It will be understood that in the drawing figures, like reference numerals refer to like features and structures.

DETAILED DESCRIPTION OF THE PREFERRED EMBODIMENTS

Figure 1:
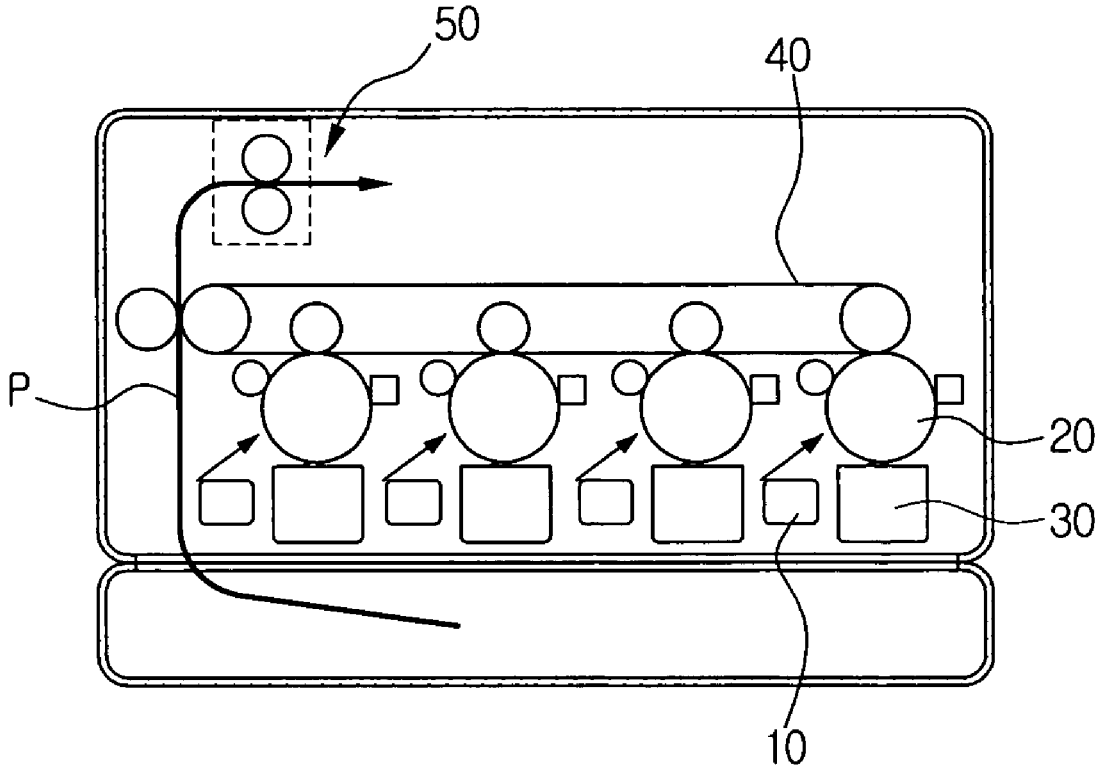
FIG. 1 (PRIOR ART)
FIG. 1 is a schematic sectional view showing a structure of a conventional wet electrophotographic printer.
Figure 2:
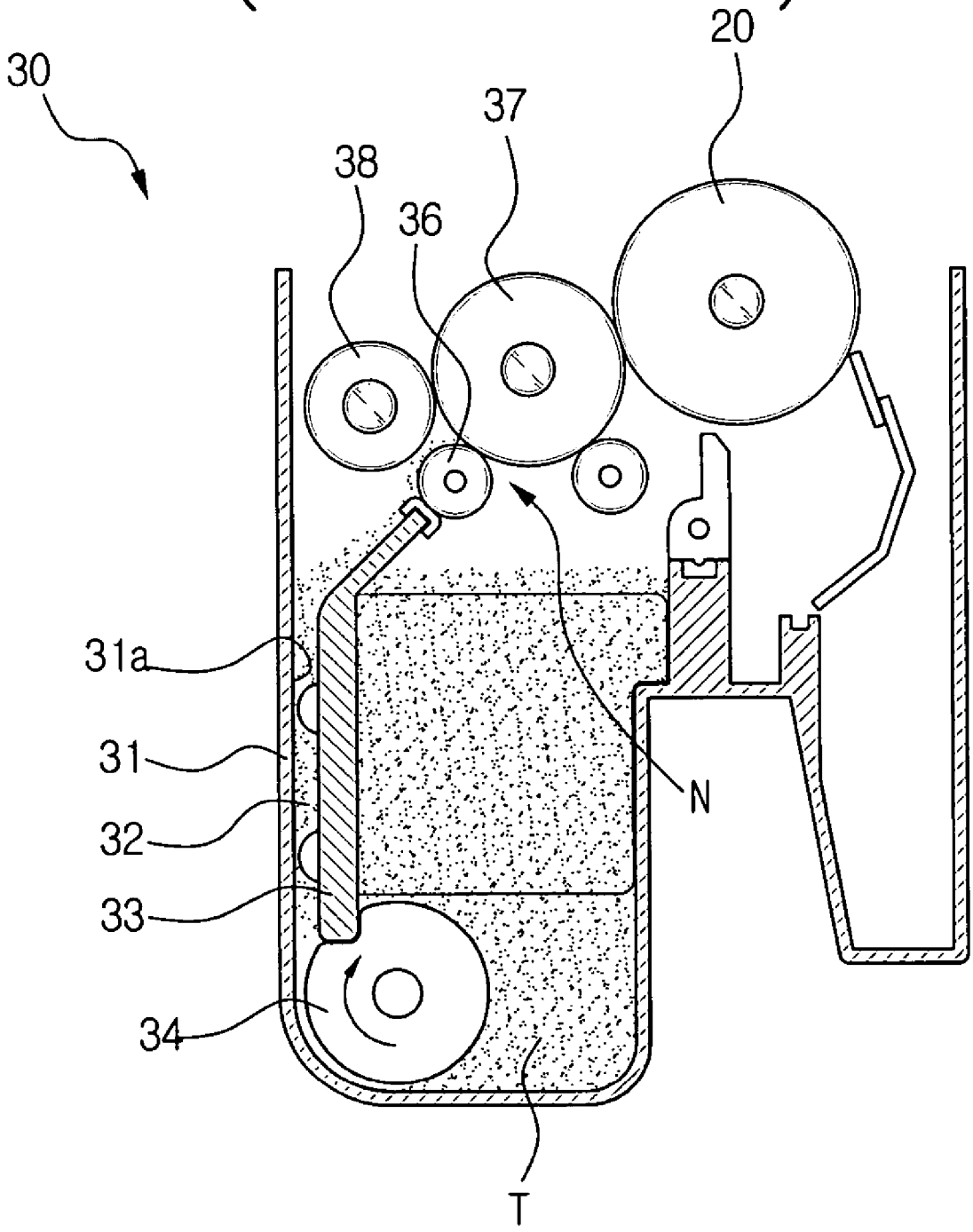
FIG. 2 (PRIOR ART)
FIG. 2 is a schematic sectional view showing a conventional developing unit of a wet electrophotographic printer.

Hereinafter, preferred embodiments of a developing unit of a wet electrophotographic printer according to an embodiment of the present invention will be described in detail with reference to the accompanying drawing figures. Further, in referring to the elements having the same structure and operation as in the prior art, the elements will be cited by the same reference numerals throughout.

Figure 3:
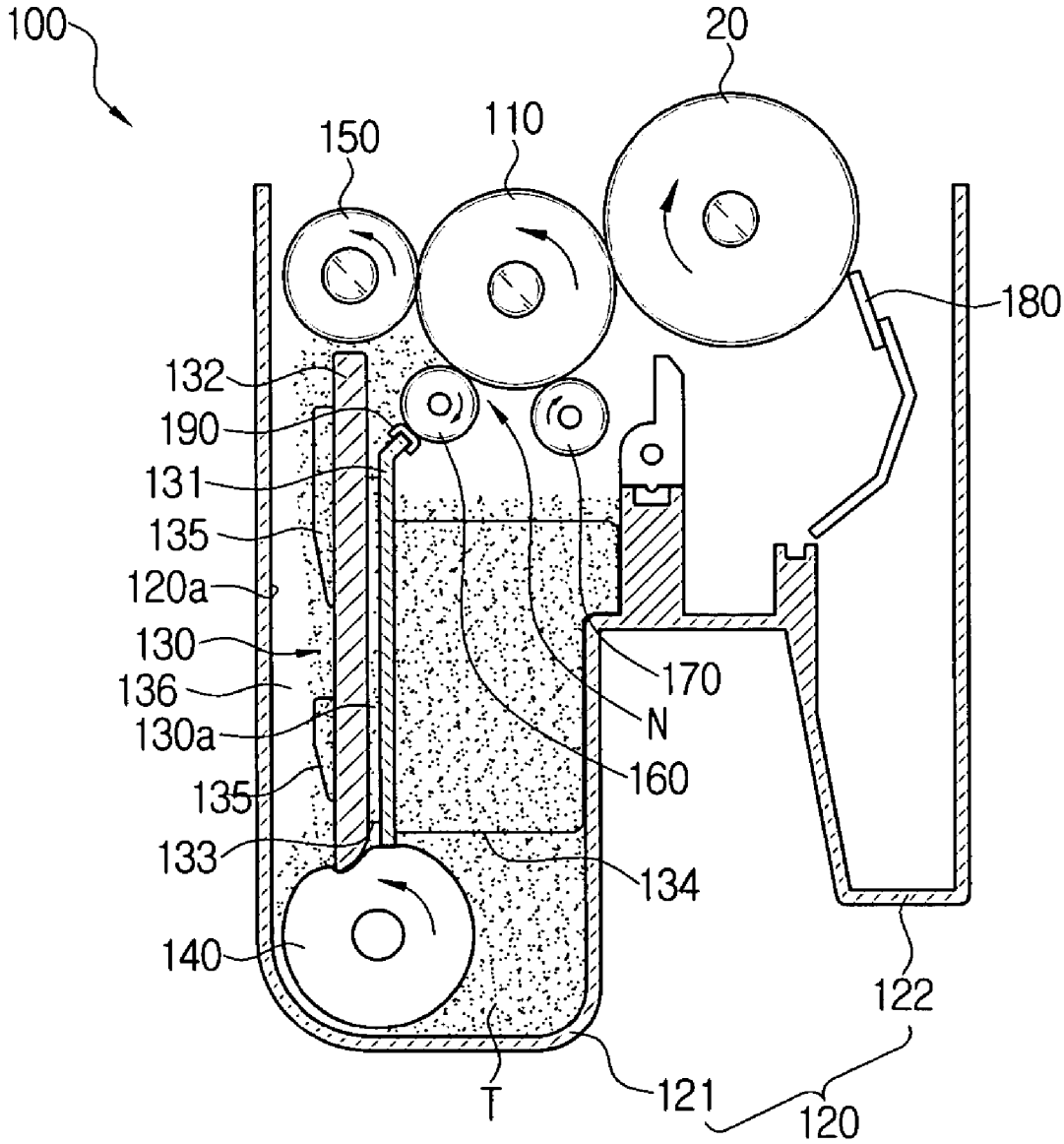
FIG. 3 is a schematic sectional view showing a developing unit of a wet electrophotographic printer according to an embodiment of the present invention.

As shown in FIG. 3, a developing unit 100 of a wet electrophotographic printer according to the present invention comprises a developing roller 110 for transferring developer onto a photoconductive drum 20, a cartridge 120 for storing the developer T therein, a developer guide 130 for supplying the developer T to the developing roller 110, a pumping roller 140 for moving the developer T to the developing roller 110, and a cleaning roller 150 for removing a developer remaining on the developing roller 110.

The developing roller 110 transfers the developer T onto an electrostatic latent image formed on the photoconductive drum 20, rotating close to the photoconductive drum 20. Accordingly, the electrostatic latent image is developed into a visible image. On one side of the developing roller 110, a deposit roller 160 is disposed close to the developing roller 110, such that a deposit nip N is formed between the developing roller 110 and the deposit roller 160. The developer T moved through the developer guide 130 is supplied to the developing roller 110 at the deposit nip N. In addition, on the other side of the developing roller 110, a metering roller 170 is mounted close to the developing roller 110 to regulate the amount of the developer T, which is supplied from developing roller 110 to the photoconductive drum 20.

The cartridge 120 stores a predetermined amount of developer T therein, and comprises a developer storage portion 121 which is recharged to maintain a predetermined charging level of the developer T, and a waste developer collecting portion 122 for collecting waste developer. In an upper part of the waste developer collecting portion 122, a cleaning blade 180 is mounted contacting the photoconductive drum 20, to remove the waste developer remaining on a surface of the photoconductive drum 20. The waste developer is separated from the surface of the photoconductive drum 20 by the cleaning blade 180, and collected in the waste developer collecting portion 122.

Figure 4:
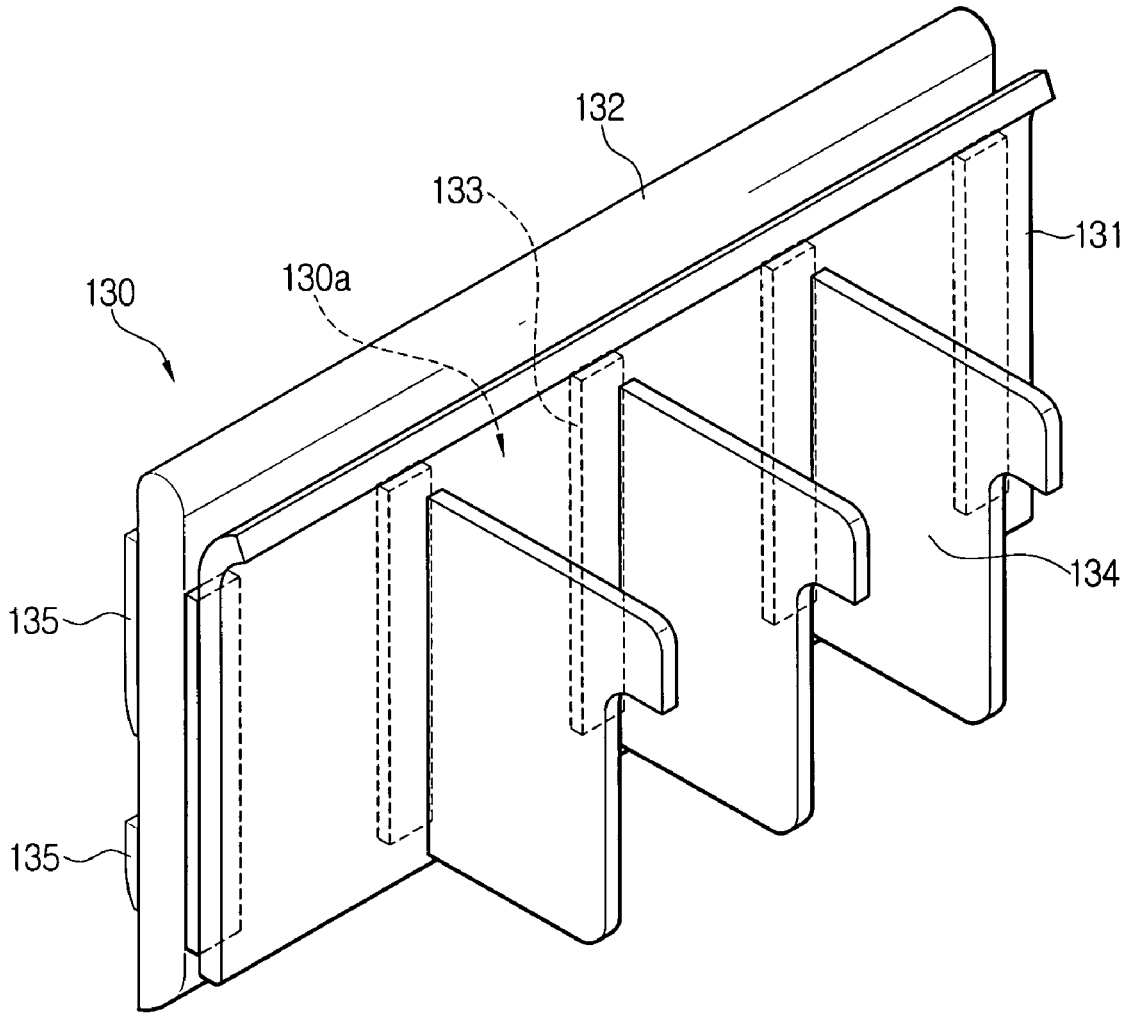
FIG. 4 is a perspective view of the main elements of the developing unit of FIG. 3.

The developer guide 130 guides the developer T stored in the developer storage portion 121 to the developing roller 110, and is disposed in the developer storage portion 121 at a predetermined distance from an inner wall 120*a* of the cartridge 120. As shown in FIG. 4, the developer guide 130 mainly comprises a first partition 131 and a second partition 132, which are connected by a connection rib 133 at a predetermined distance from each other. A developer supplying path 130*a* is formed between the first and the second partitions 131, 132 for the developer T to flow therethrough, and a developer collecting path 136 is formed between the second partition 132 and the inner wall 120*a* of the cartridge 120. The height of the first partition 131 is smaller than the height of the second partition 132, and the upper part of the second partition 132 is higher than the upper part of the first partition 131, while the lower part of the first partition 131 is higher than the lower part of the second partition 132.

When the developing unit 100 is completely assembled, the upper part of the first partition 131 is lower than the deposit nip N between the developing roller 110 and the deposit roller 160, and the upper part of the second partition 132 is higher than the deposit nip N. Further, the upper part of the first partition 131 is bent outward, and a packing member 190 is mounted to enclose the bent end. Additionally, a plurality of blocking members 134 are disposed on the external sidewall of the first partition 131 at predetermined intervals. The blocking members 134 prevent the developer T in the developer storage portion 121 from fluctuating due to an impact on the cartridge 120, by dividing the developer storage portion 121 with a plurality of the partitions when the developer guide 130 is mounted in the cartridge 120. In addition, a plurality of supplement ribs 135 are formed on the external sidewall of the second partition 132. The supplement ribs 135 prevent the second partition 132 from distorting during a shaping thereof.

On the other hand, it has been described above that the developer guide 130 is mounted in the cartridge 120, wherein the first partition 131 and the second partition 132 are integrally formed. However, the present invention is not limited to this preferred embodiment. That is, for example, the first partition 131 and the second partition 132 can be separately mounted in the cartridge 120 at a predetermined distance, with the developer supplying path 130*a* formed therebetween.

The pumping roller 140 is disposed on a lower part of the developer guide 130 to pump up the developer T from the developer storage portion 121 to the developing roller 110. The pumping roller 140 is made of a sponge material which is absorbent, contacting with a predetermined pressure to a lower part of the first and second partitions 131, 132, respectively. Here, the pumping roller 140 contacts with a higher pressure to the lower part of the second partition 132 than to the lower part of the first partition 131. That is, the contacting surface of the pumping roller 140 with the first partition 131 is not deformed, while the contacting surface of the pumping roller 140 with the second partition 132 is compressed and thus deformed. Accordingly, as the pumping roller 140 is rotated in a direction from the first partition 131 to the second partition 132, the developer T absorbed into the pumping roller 140 is spouted outward and flowed along the developer supplying path 130*a* between the first partition 131 and the second partition 132. At this time, a part of the developer T is flowed to the deposit nip N, and the remaining developer T is overflowed to the upper part of the second partition 132.

The cleaning roller 150 removes the developer T remaining on the developing roller 110 after the developer T adheres onto the photoconductive drum 20, and is made of an absorbent material such as a sponge. The cleaning roller 150 wipes the developer T on the developing roller 110, while rotating in contact with the surface of the developing roller 110 on one side thereof.

Hereinafter, the operation of a developing unit of a wet electrophotographic printer according to the present invention will be described, mainly with reference to FIG. 3. In assembling the developing unit 100, the developer guide 130 is mounted in the cartridge 120 in which the pumping roller 140 is mounted, at a predetermined distance from the inner wall 120*a* of the cartridge 120, and then all the necessary rollers are mounted to the cartridge 120. The upper part of the first partition 131 is positioned lower than the deposit nip N between the developing roller 110 and the deposit roller 160, and the upper part of the second partition 132 is higher than the deposit nip N. The deposit roller 160 contacts with the packing member 190 on the upper part of the first partition 131, and the cleaning roller 150 is disposed at a predetermined distance above the upper part of the second partition 132.

In the initial printing operation, the pumping roller 140, containing the developer T, rotates counterclockwise. Accordingly, the developer T which is absorbed in the pumping roller 140 is spouted from the position where the pumping roller 140 is contacted with a lower part of the second partition 132. As a result, the developer T is flowed upward along the developer supplying path 130*a* of the developer guide 130. Here, a part of the rising developer T is moved to the deposit nip N between the developing roller 110 and the deposit roller 160, along the upper part of the first partition 131 of which one end is bent toward the deposit roller 110. The rest of the developer T is overflowed to the upper part of the second partition 132, and then flowed to the developer collecting path 136 between the inner wall 120*a* of the cartridge 120 and the second partition 132. Since the deposit nip N is at a lower plane than the second partition 132, there is formed a space defined between the second partition 132 and the deposit nip N to be filled with the developer T. Therefore, when the developer T overflows to the upper part of the second partition 132 by the operation of the pumping roller 140, developer T can be supplied to the deposit nip N sufficiently and regularly.

At the deposit nip N, the developer T adheres onto the surface of the rotating developing roller 110. The developer T attached onto the developing roller 110 is regulated by the metering roller 170 to a desired amount, and then adheres onto the photoconductive drum 20 to develop an electrostatic latent image on the photoconductive drum 20 to a visible image. Most of the developer T attached onto the photoconductive drum 20 is transferred to a printing paper P of FIG. 1 by a transfer belt 40 of FIG. 1. The remnant of the developer T after the transfer to the printing paper P is separated from the photoconductive drum 20 by the cleaning blade 180, and collected into the waste developer collecting portion 122.

Meanwhile, the developer T which is overflowed to the space between the inner wall 120*a* of the cartridge 120 and the second partition 132 at the upper part of the second partition 132, is mixed with the developer T stored in the developer storage portion 121, and then supplied again along the developer supplying path 130*a* by the pumping operation of the pumping roller 140.

According to the present invention, as described above, the developer T, which is pumped by the pumping roller 140, is flowed upward along the narrow developer supplying path 130*a* between the first partition 131 and the second partition 132 of the developer guide 130, while partially being overflowed to the upper part of the second partition 132 which is positioned higher than the deposit nip N. Accordingly, developer T can be supplied to the deposit nip N in a sufficient amount. Therefore, the developing unit 100 can supply a sufficient amount of a developer T to a developing roller 110. Further, a developing unit of a wet electrophotographic printer can be provided which regularly supplies the developer T to the developing roller 110 regardless of the level or a viscosity of the developer, and thereby providing a good quality printing.

In addition, according to the present invention, since the waste developer T, which is removed by the cleaning roller 150 from the surface of the developing roller 110, is not mixed with the developer T which is supplied to the developing roller 110 by the pumping roller 140. The developer T of a sludge form is not directly supplied to the developing roller 140, as occurs in the conventional art, and therefore printing quality deterioration can be prevented.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A developing unit of a wet electrophotographic printer, comprising:

a photoconductive drum;

a developing roller for attaching a developer onto the photoconductive drum;

a cartridge for storing a developer therein;

a deposit roller for transferring the developer onto the developing roller, a deposit nip being defined between the developing roller and the deposit roller;

a developer guide disposed at a predetermined distance away from an inner wall of the cartridge, and having a developer supplying path defined therein to guide the developer in the cartridge to the developing roller, the developer guide comprising:

a first partition contacting an upper wall thereof with the deposit roller, the upper part of the first partition being positioned lower than the deposit nip; and a second partition disposed near to the inner wall of the cartridge, the second partition forming the developer supplying path in cooperation with the first partition and defining a developer collection path between the second partition and the inner wall of the cartridge, the upper part of the second partition being positioned higher than the deposit nip; and a developer pump disposed in the cartridge to pump up the developer in the cartridge toward the developing roller along the developer supplying path, the developer which flows along the developer supplying path being moved in part to the deposit nip and overflowing in part to the upper part of the second partition to be moved to the developer collecting path.

2. The developing unit of claim 1, further comprising connecting means for connecting the first partition and the second partition which are integrally mounted in the cartridge, respectively.

3. The developing unit of claim 1, wherein the first partition and the second partition are separately mounted in the cartridge.

4. The developing unit of claim 1, wherein the developer pump includes a pumping roller which is made of a sponge material and mounted to contact with the lower part of the developer guide.

5. The developing unit of claim 1, wherein the developer pump includes a pumping roller which is made of a sponge material and mounted to contact with lower parts of the first partition and the second partition.

6. The developing unit of claim 5, wherein the pumping roller contacts with a higher pressure with the lower part of the second partition than with the lower part of the first partition, and rotates in a direction from the first partition to the second partition.

7. The developing unit of claim 6, wherein the lower part of the first partition is positioned higher than the lower part of the second partition.

8. The developing unit of claim 1, further comprising a cleaning roller for removing the developer remaining on the developing roller in contact with the developing roller, wherein the developer which is removed from the developing roller by the cleaning roller is moved into a space defined between the inner wall of the cartridge and the developer guide.

9. A developer guide for a developing unit of a wet electrophotographic printer having a photoconductive drum, a developing roller for attaching a developer onto the photoconductive drum, and a cartridge for storing the developer therein, the developer guide comprising:

a first partition contacting with an upper wall thereof with a deposit roller;

a second partition disposed near to the inner wall of the cartridge to form a developer supplying path in cooperation with the first partition; and a developer pump disposed in the cartridge to pump up the developer in the cartridge toward the developing roller, the developer pump includes a pumping roller which is made of a sponge material and mounted to contact with lower parts of the first partition and the second partition.

10. The developer guide of claim 9, further comprising a deposit nip defined between the developing roller and the deposit roller.

11. The developer guide of claim 10, wherein the upper part of the first partition is positioned lower than the deposit nip.

12. The developer guide of claim 10, wherein the upper part of the second partition is positioned higher than the deposit nip.

13. The developer guide of claim 10, wherein the developer which flows along the developer supplying path is moved in part to the deposit nip and overflowed in part to the upper part of the second partition to be moved to a developer collecting path defined between the second partition and the inner wall of the cartridge.

14. The developer guide of claim 9, wherein the developer guide is disposed at a predetermined distance away from an inner wall of the cartridge.

15. The developer guide of claim 9, further comprising connecting means for connecting the first partition and the second partition which are integrally mounted in the cartridge, respectively.

16. The developer unit of claim 9, wherein the first partition and the second partition are separately mounted in the cartridge.

17. The developer guide of claim 9, wherein the pumping roller contacts with a higher pressure with the lower part of the second partition than with the lower part of the first partition, and rotates in a direction from the first partition to the second partition.

18. The developer guide of claim 9, wherein the lower part of the first partition is positioned higher than the lower part of the second partition.

* * * * *